US005103657A

United States Patent [19]

Horita et al.

[11] Patent Number: 5,103,657

[45] Date of Patent: * Apr. 14, 1992

[54] SLIDE FASTENER

[75] Inventors: Yoshiyuki Horita, Toyama; Kiyoyasu Wake, Kawasaki, both of Japan

[73] Assignees: Yoshida Kogyo, K.K.; Miwa Lock Co., Ltd., both of Tokyo, Japan

[ * ] Notice: The portion of the term of this patent subsequent to Dec. 11, 2007 has been disclaimed.

[21] Appl. No.: 535,586

[22] Filed: Jun. 11, 1990

[30] Foreign Application Priority Data

Jun. 13, 1989 [JP] Japan ..... 1-152006

[51] Int. Cl.[5] ..... E05B 67/38

[52] U.S. Cl. ..... 70/68; 70/312

[58] Field of Search ..... 70/68; 24/418, 419, 24/421, 425, 436; 29/408, 766

[56] References Cited

U.S. PATENT DOCUMENTS

| | | | |
|---|---|---|---|
| 2,032,019 | 2/1936 | Jordan | 70/68 |
| 2,664,738 | 1/1954 | Paganini | 70/68 |
| 2,741,114 | 4/1956 | Poux | 70/68 |
| 2,879,588 | 3/1959 | Morin | 29/408 |
| 2,949,666 | 8/1960 | Rogers et al. | 29/408 |
| 4,015,457 | 4/1977 | Fukuroi | 70/68 |
| 4,395,891 | 8/1983 | Remington | 70/68 |
| 4,782,563 | 11/1988 | Kusayama | 24/436 |
| 4,930,323 | 6/1990 | Terada et al. | 70/68 |
| 4,932,230 | 6/1990 | Ishii et al. | 70/456 R |
| 4,976,120 | 12/1990 | Terada et al. | 70/68 |

FOREIGN PATENT DOCUMENTS

| | | | |
|---|---|---|---|
| 0110346 | 6/1984 | European Pat. Off. . | |
| 0377798 | 7/1990 | European Pat. Off. . | |
| 2527909 | 9/1983 | France . | |
| 46-17756 | 6/1971 | Japan . | |
| 48-38063 | 11/1973 | Japan . | |
| 2-161904 | 6/1990 | Japan . | |
| 734192 | 2/1953 | United Kingdom | 24/205.14 |
| 1477290 | 6/1977 | United Kingdom . | |
| 1510268 | 5/1978 | United Kingdom . | |

*Primary Examiner*—Gary L. Smith
*Assistant Examiner*—Darnell M. Boucher
*Attorney, Agent, or Firm*—Hill, Van Santen, Steadman & Simpson

[57] ABSTRACT

A slide fastener comprising a pair of stringer tapes each carrying along their respective inner longitudinal edges a row of coupling elements. The slide fastener is produced from a continuous fastener chain having mounted thereon alternate sliders and top end stops both movable along the rows of coupling elements. Either the slider or the top end stop is provided with a latch for retaining the slider in provisionally or completely locked engagement with the top end stop.

3 Claims, 8 Drawing Sheets

SLIDE FASTENER

BACKGROUND OF THE INVENTION

1. Field of the Invention

This invention relates generally to slide fasteners and particularly to such a slide fastener which has a slider lockable with a top end stop.

2. Prior Art

Slide fasteners have heretofore found extensive application on a variety of garment articles such as clothings, bags, tents, suitcases and the like. With a slide fastener used for example on a bag while in transit, it is not always necessary to fully lock the slider but often desirable to keep it provisionally locked. A typical example of such device is disclosed in Japanese Utility Model Publication No. 46-17756 in which a latch provided on a bag or the like has a pair of spring-biased pins engageable in cavities formed in a slider having an integral prong lockable with the latch. Since it is located on the bag at a level, the latch is often positioned out of alignment with the slider on the fastener at another level the latch unless extreme care and tedious effort are paid.

SUMMARY OF THE INVENTION

With the foregoing difficulties of the prior art in view, the present invention has for an object to provide a slide fastener which has a slider easily engageable lockably with and disengageable from a top end stop.

Another object of the invention is to provide a slide fastener having a latch means incorporated either in a slider or in a top end stop, the latch having a "provisional" and a "complete" lock function.

Another object of the invention is to provide a slide fastener produced from a continuous fastener chain carrying a plurality of alternate sliders and top end stops which are movable on and attachable where desired on to the fastener chain.

These and other objects of the invention will appear clear from the following detailed description taken in conjunction with the accompanying drawings which illustrate by way of example some preferred embodiments.

According to the invention, there is provided a slide fastener produced from a continuous fastener chain comprising a pair of stringer tapes each carrying respective rows of coupling elements along their respective inner longitudinal edges, a plurality of alternate sliders and top end stops both movable along the rows of coupling elements, each of the sliders having an upper wing and a lower wing joined at one of their ends by a neck and defining therebetween a guide channel for the passage of the rows of coupling elements and a wing extension extending forwardly of the neck and having a lock cavity, the top end stop having an upper wing extension and a lower wing extension extending in parallel with each other and defining therebetween a guide opening for receiving the wing extension of the slider, the top end stop further incorporating a latch movable into and out of the guide opening and adapted to engage with the lock cavity, a spring normally urging the latch toward the opening, and a lock device for selectively locking and unlocking the latch.

BRIEF DESCRIPTION OF THE DRAWINGS

In the drawings in which like reference numerals refer to like or corresponding parts throughout the several views.

DETAILED DESCRIPTION OF THE INVENTION

Figure 1:
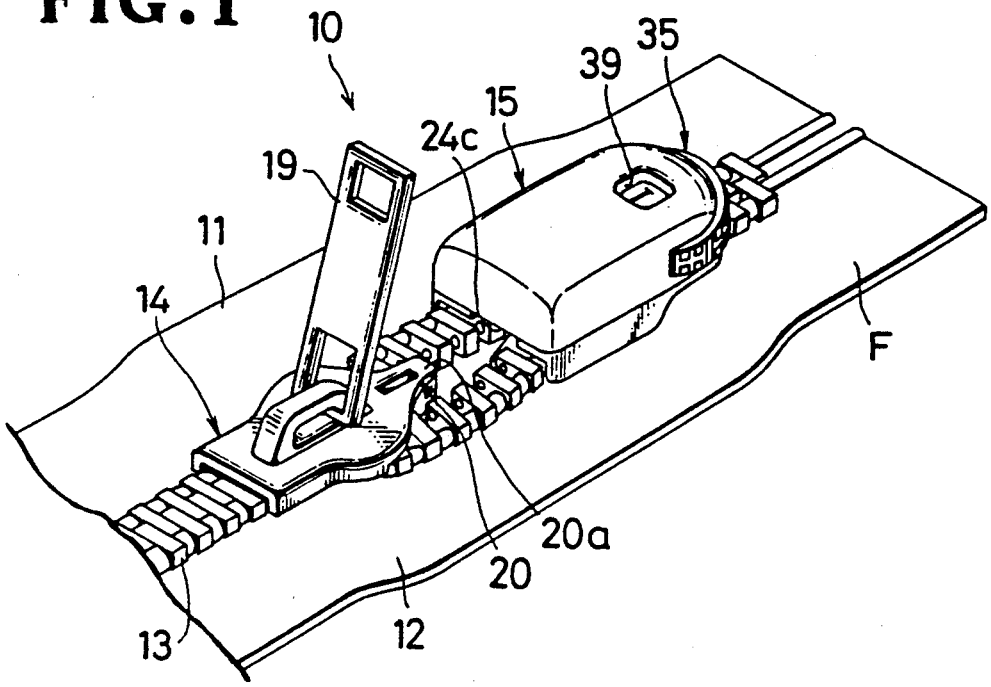
FIG. 1 is a perspective view of a slide fastener embodying the invention.
Figure 2:
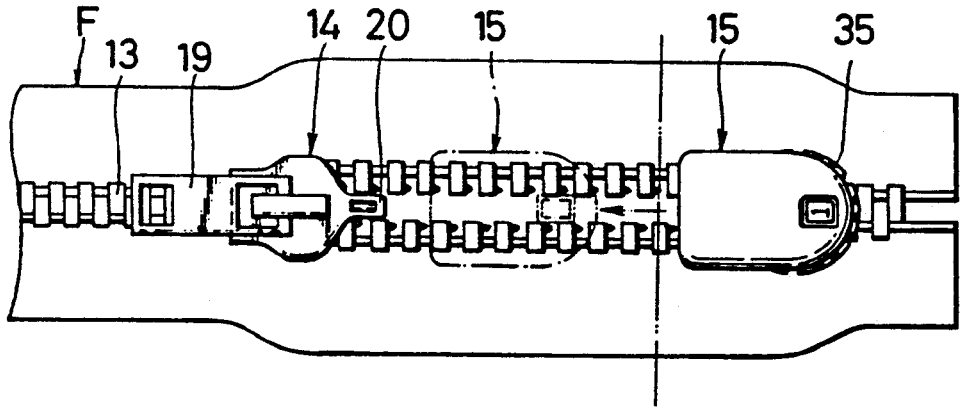
FIG. 2 is a plan view of the same.

Referring now to the drawings and FIGS. 1 and 2 in particular, there is shown a slide fastener 10 embodying the present invention which comprises a pair of stringer tapes 11 and 12 each carrying on and along their respective inner longitudinal edges a row of coupling elements 13, a slider 14 reciprocably movable along the coupling elements 13 to open and close the slide fastener in a well known manner, and a top end stop 15 similarly reciprocably movable along the coupling elements 13 and adapted to be secured in place on one end of the slide fastener 10 for limiting thereat the movement of the slider 14.

The slider 14 has an upper wing 16 and a lower wing 17 joined together at one of their ends by a neck 18 which is commonly termed a "diamond" and defining therebetween a guide channel for the passage of the slide fastener stringers and a pull tab 19 adapted to move the slider 14 along the row of coupling elements 13.

The slider 14 has a one-piece wing extension 20 tapered and extending forwardly of the neck 18 and having an upper surface **20*a* lying flush with the upper surface of the upper wing 16 and a lower flat surface 20***b* offset from the lower wing 17. The wing extension 20 has a lock cavity 20*c* formed in its upper surface 20*a* and cross-sectionally defined by an arcuate bottom wall 20*d* and a vertical end wall 20*e* at an leading end of the extension 20, the cavity 20*c* increasing in depth progressively toward the vertical wall 20*e*, as better shown in FIGS. 3 and 9. The wing extension 20 is provided at its lower leading end portion with an upwardly canted cam surface 20*f* for purposes hereafter to be described.

The top end stop 15 has an upper wing 21 and a lower wing 22 joined together by a neck 23 and includes a two-piece wing extension 24 consisting of an upper wing extension 24*a* and a lower wing extension 24*b* extending integrally from the upper wing 21 and the lower wing 22 respectively and forwardly of the neck 23. The upper and lower extensions 24*a* and 24*b* are in spaced parallel relation to each other, defining therebetween a guide opening 24*c* for receiving the wing extension 20 of the slider 14. The upper wing extension 24*a* has an aperture 24*d* communicating with the guide opening 24*c*.

The neck 23 of the top end stop 15 has a downwardly canted front end surface 23*a* disposed in the opening 24*c* for face-to-face engagement with the canted cam surface 20*f* of the slider wing extension 20.

Designated at 25 is a casing encompassing and attached to the upper wing 21 of the top end stop 15.

Figure 5:
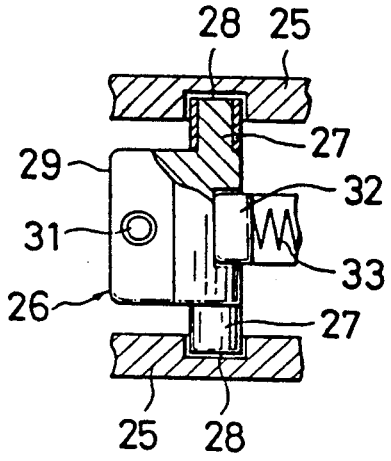
FIG. 5 is a top view, partly sectional, of a locking means incorporated in the top end stop.

A lock tumbler of latch 26 is pivotaly mounted through the aperture 24*d* in the casing 25 to enter into and retract from the guide opening 24*c* in the casing 25 of the top end stop 15. More specifically, the tumbler 26 has an integral transverse pin 27 received in vertically elongated guide slots 28 formed in opposite side walls of the casing 25, as better shown in FIG. 5, so that the tumbler 26 can rotate and move vertically linearly as well along the guide slots 28. The lock tumbler 26 is provided at one end with an integral lock prong 29 shaped in conformity with and hence engageable with the lock cavity 20*c* of the slider 14 with a tight fit in a manner hereafter to be described. At the other end of the tumbler 26 is an integral abutment 30.

Figure 3:
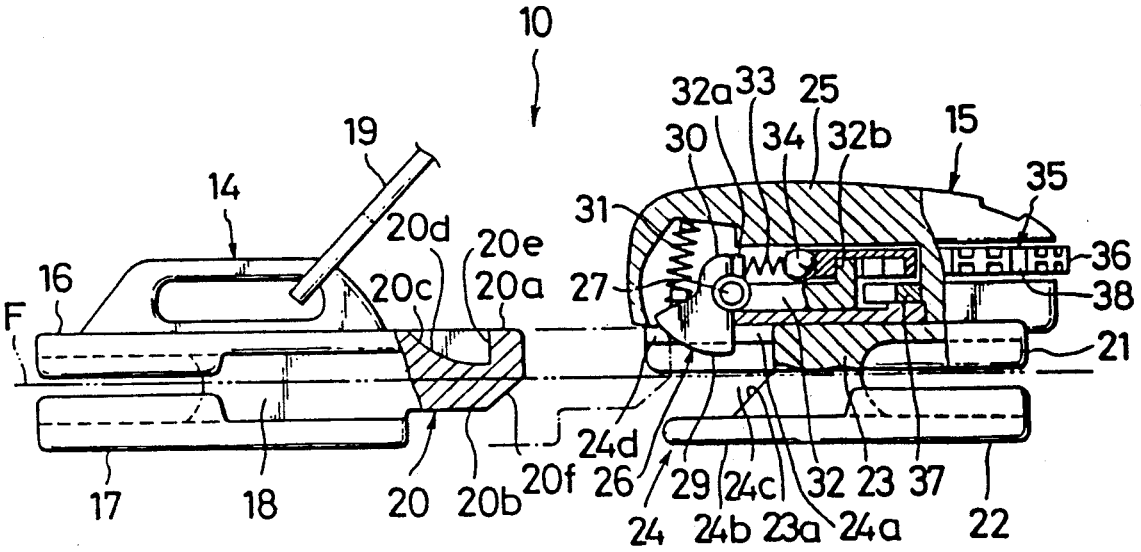
FIG. 3 is a side elevational, partly sectional view of a slider and a top end stop both slidably mounted on the fastener of FIG. 1.

The lock tumbler 26 is normally urged downwardly toward the guide opening 24*c* by means of a first compression spring 31 supported vertically in place within the casing 25 as shown in FIG. 3.

A slide bracket 32 has integral vertical ribs 32*a* and 32*b* protruding upwardly from opposite ends thereof and is mounted in the casing 25 horizontally movably above the upper wing 21 of the top end stop 15. The bracket 32 is normally urged horizontally toward the tumbler 26 by means of a second compression spring 33 having one end connected to the ribs 32*a* and the other end connected via ball 34 to the periphery of a first dial later described.

Figure 6:
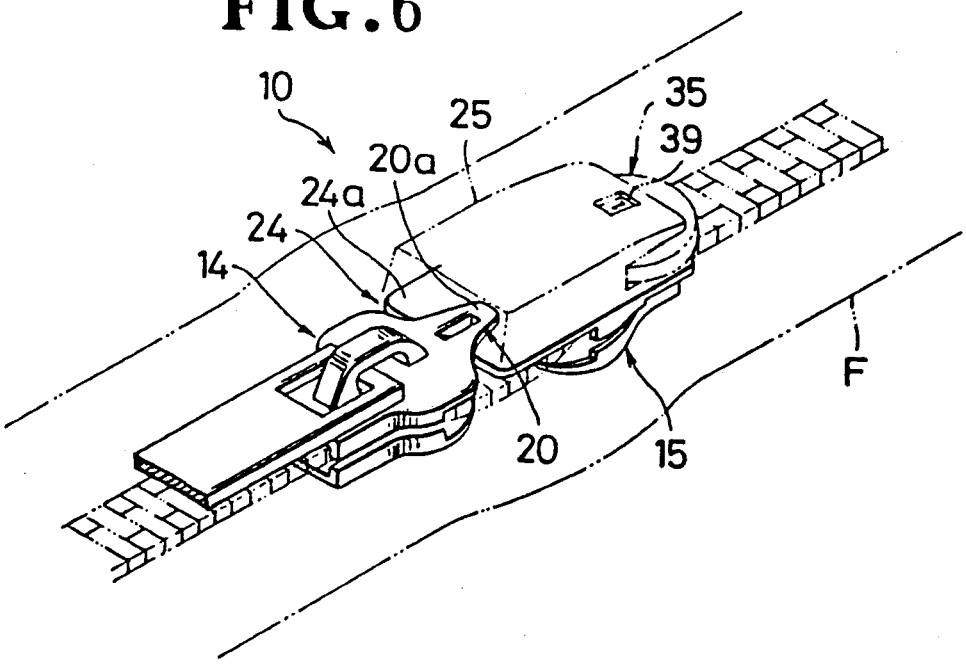
FIG. 6 is a view similar to FIG. 1 but showing the slider and the top end stop coupled together.

A dual dial device 35 comprises a first dial 36 and a second dial 37 disposed in superposed relation to each other and each rotatably mounted in the casing 25 and partly protruding from a rear end thereof remote from the lock tumbler 26. The first or upper dial 36 has a predetermined number of equally spaced peripheral grooves 38 engageable with the ball 34 connected to the second spring 33 so that the dial device 35 can rotate resiliently intermittently. The first dial 36 carries on its upper surface an array of indicia such as numerical figures which are successively exposed to view through a window 39 formed in the top wall of the casing 35 as the dial is rotated, as shown in FIG. 6.

The first and second dials 36 and 37 are rotatable relatively to each other by means of for example respective confrontable pins (not shown), and have engaging peripheral notches 36*a* and 37*a*, respectively, which are selectively engageable with the vertical rib 32*b* of the slide bracket 32.

Figure 7:
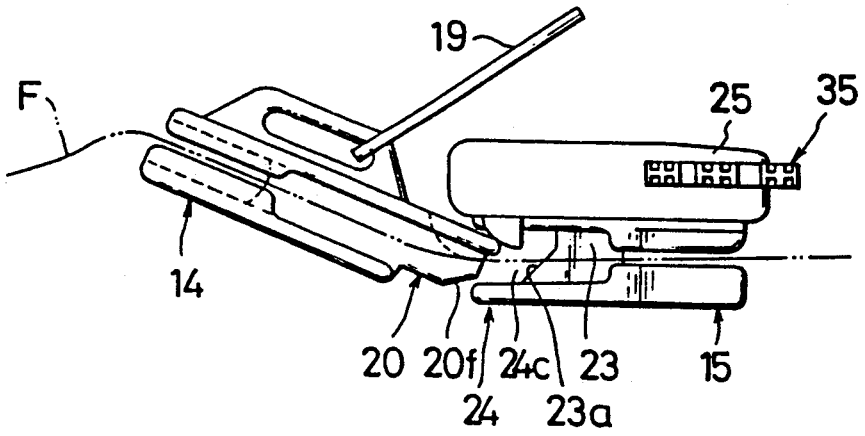
FIG. 7 is a side elevational view of the slider and the top end stop showing both in the process of being coupled together.
Figure 8:
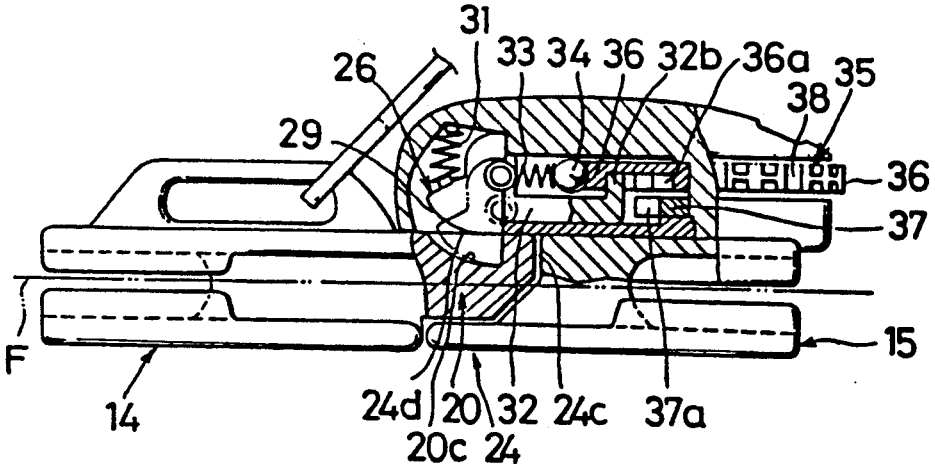
FIG. 8 is a side elevational view of the slider and the top end stop (partly sectional) showing both immediately prior top mutual coupling.
Figure 10:
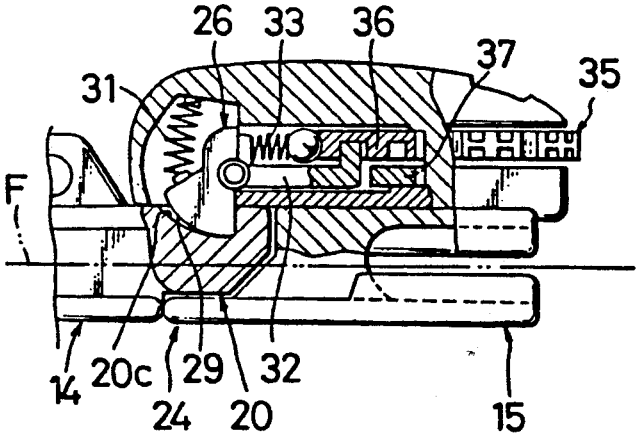
FIG. 10 is a view similar to FIG. 8 but showing the slider and the top end stop in coupled disposition.

With this construction, the sliders 14 and the top end stop 15 are brought into coupling engagement with each other by, for instance, inserting the wing extension 20 of the slider 14 into the guide opening 24*c* in the top end stop 15 as shown in FIG. 7, in which instance, the slider 14 is apt to tilt forwardly as it is pulled by the tab 19, and the cam surface 20*f* of the extension 20 moves in sliding engagement with the front end of the lower wing 22 of the top end stop 15 and thus aids in smooth entry of the slider wing extension 20, while the lock prong 29 is lifted in contact with a leading upper surface portion of the wing extension 20 against tension of the first spring 31 and upon registry with the lock cavity 20*c*, the prong 29 is urged by the spring 31 downwardly into the cavity 20*c* as shown in FIGS. 8 and 10.

In this instance, the rows of coupling elements 13 which are located at a junction between the slider 14 and the top end stop 15 are not coupled together but the fastener stringers at that location are guarded by the wing construction 24 of the top end stop 15 against being pulled laterally outwardly which would otherwise take place when severe lateral pull is exerted on the slide fastener.

Figure 9:
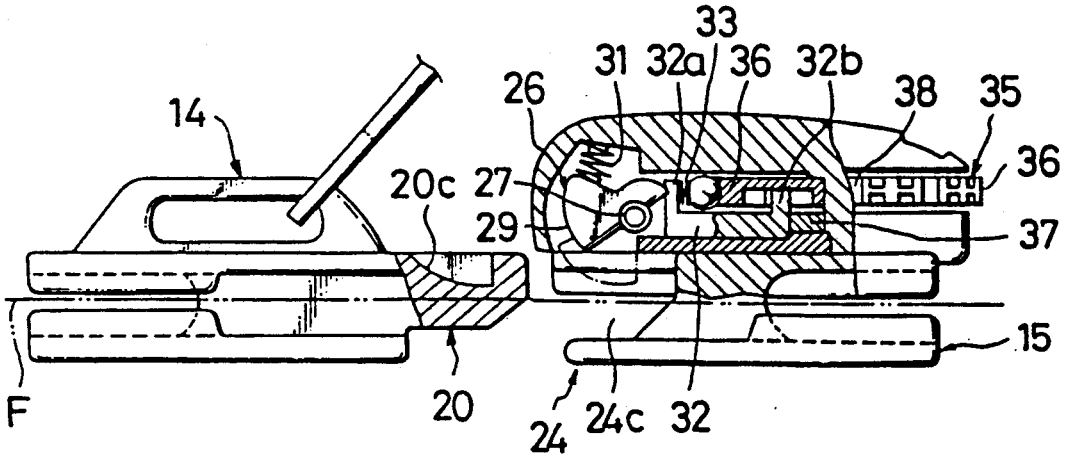
FIG. 9 is a view similar to FIG. 8 but showing the slider and the top end stop in separated disposition.

When separating the slider 14 from the top end stop 15, they can be pulled away from each other with a tensile strength great enough to overcome a compression strength of the first spring 31 to release the lock prong 29 from the lock cavity 20*c*, in which instance the lock spring 29 is so released as the tumbler 26 rotates clockwise (as viewed in the drawings) on its pin 27 until the lock prong 29 is displaced clear of the guide opening 24*c*, as shown in FIG. 9. Immediately upon departure of the slider 14, the tumbler 26 is returned by the action of the first spring 31 to its original position with the lock prong 29 protruding back into the guide opening 24*c*.

The dual dial device 35 is utilized to permit and prohibit movement of the lock tumbler 26 into and out of the guide opening 24*c* in the top end stop 15. In a typical mode of operation, the first dial 36 is rotated in either or one direction until a selected combination of indicia appears in the window 39 so that the engaging notch 37*a* of the second dial 37 registers with the rib 32*b* of the slide bracket 32, and the first dial 36 is then rotated in the opposite direction until another selected combination appears in the window 39 to bring the engaging notch 36*a* of the first dial 36 into registry with the rib 32*b* of the bracket 32. This position represents an "unlock" or "provisional lock" condition of the slider 14 with respect to the top end stop 15 as depicted in FIG. 8, in which condition the slider 14 can be drawn apart from the top end stop 15 with a pull just strong enough to overcome the compression strength of the first spring 31 in a manner already described.

Rotating the first dial 36 and/or the second dial 37 away from the above "unlock" position will shift their respective notches 36*a*, 37*b* out of registry or alignment with the bracket rib 32*b* and thereby bring the slider 14 into "complete lock" engagement with the top end stop 15, in which position the lock prong 29 is not rotatable but retained in locked engagement with the lock cavity 20*c* of the slider wing extension 20, prohibiting separation of the slider 14 from the top end stop 15. Since the lock tumbler 26 is vertically movable, the slider 14 and the top end stop 15 can be readily coupled by thrusting the slider wing extension 20 into the guide opening 24*c* and locked together immediately upon fitting engagement of the lock prong 29 with the lock cavity 20*c*.

FIGS. 11–14, inclusive, show a modified form of the lock device incorporated in the top end stop 15, in which there is provided a key-operated lock device in place of the dial device 35 which has been already described. The key-operated lock device 100 is shown, including a portion of the slider wing extension 110 which is provided in its upper surface with a relatively shallow, arcuately shaped lock cavity 110*a* corresponding to the lock cavity 20*c*, the remaining structural detailes of the slider 14 being identical those already described and hence omitted.

A tumbler 200 is in the form of a lock roller 210 rotatably connected to one end of a first bracket 220, the other end of which is pivotally connected to one end of a second bracket 230. The lock roller 210 takes the place of the lock prong 29 and is likewise normally urged by the first spring 31 downwardly toward the guide opening 24*c* in the top end stop 15. The other end of the second bracket 230 is connected via a spring 240 to a crank arm 250 (corresponding to the slide bracket 32) having an elongated horizontal engaging portion 250*a* at one end and a finger portion 250*b* at the opposite end. The finger portion 250*b* is offset from the horizontal engaging portion 250*a* so that its end surface lies substantially flush with or slightly above the upper surface of the second bracket 230.

Figure 12:
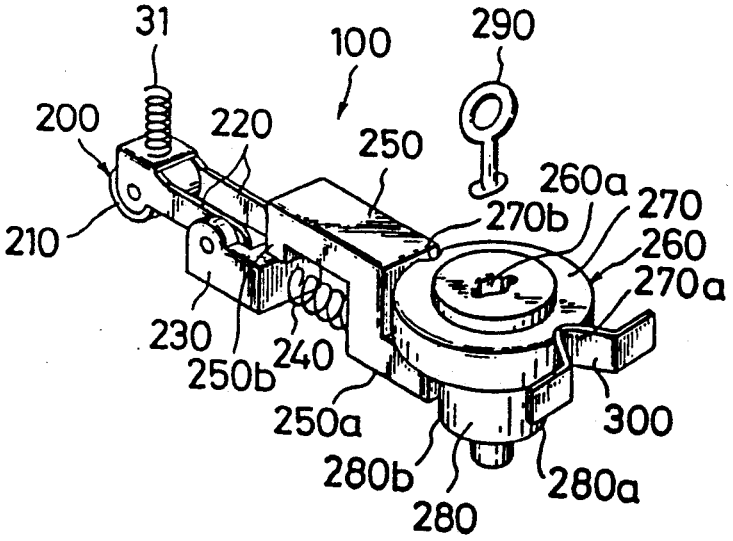
FIG. 12 is a perspective view of the locking means of FIG. 11.
Figure 13:
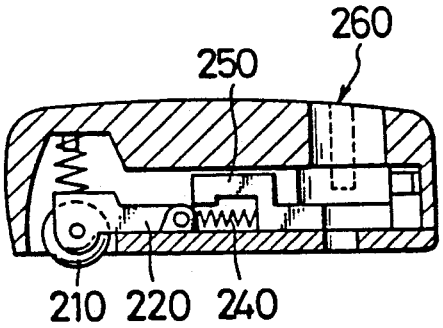
FIG. 13 is a side elevational, partly sectional view of the locking means of FIG. 11 showing the same in unlocked disposition.

A key-operated latch 260 having a top-like configuration, as shown in FIG. 12, has a large-diameter disc 270 and a small-diameter cam disc 280 formed integrally but eccentrically with the disc 270. The cam disc 280 thus has a first peripheral portion 280*a* coextensive with the periphery of the large-diameter disc 270 and a second peripheral portion 280*b* offset from the periphery of the disc 270. The latch 260 is rotatably mounted in the casing 25 and has a key hole 260*a* in a portion of its upper surface which is exposed through the casing 25 for engagement with a key 290. The large-diameter disc 270 has a pair of diametrically opposed peripheral notches 270*a* and 270*b* which are adapted to receive the apex of a triangular leaf spring 300 secured to the inner wall of the casing 25.

Figure 11:
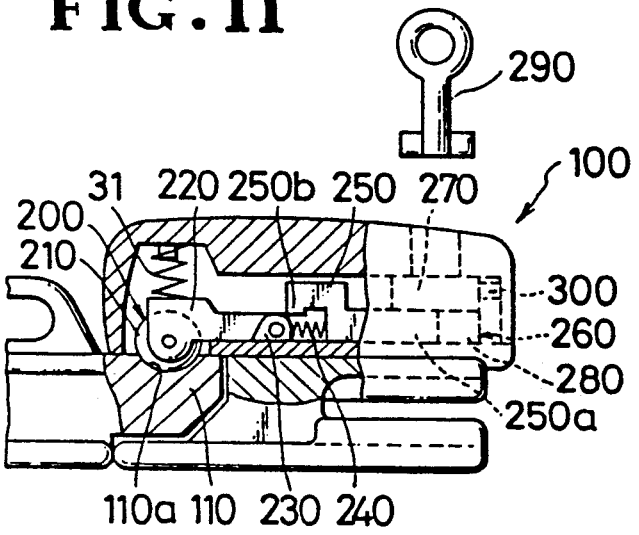
FIG. 11 is a side elevational, partly sectional view of a modified form of locking means.
Figure 14:
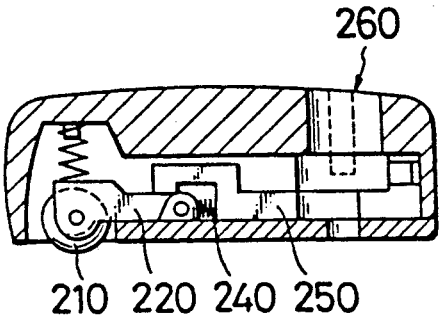
FIG. 14 is a view similar to FIG. 13 but showing the locking means in locked disposition.

Rotating the latch 260 with the key 290 in the hole 260*a* in one or the other direction for 180° will bring either of the two notches 270*a* and 270*b* into locking engagement with the leaf spring 300. When the latch 260 is rotated so as to register the notch 270*a* with the apex of the leaf spring 300 as shown in FIGS. 10 and 11, the crank arm 250 is positioned with its finger portion 250*b* held apart from the upper surface of the second bracket 230 and with its engaging portion 250*a* in abutting relation to the second peripheral portion 280*b* of the cam disc 280, in which position the slider 14 is unlocked with respect to the top end stop 15 as the first bracket 220, hence the lock roller 210, is free to move away from the lock cavity 110*a*. By rotating the latch 260 another 180° until the opposite notch 270*b* engages the leaf spring 300, the slider 14 and the top end stop 15 are completely locked because the first peripheral portion 280*a* of the cam disc 280 confronts and pushes the crank arm 250 toward the lock roller 210 against the tension of the spring 240 until the finger portion 250*b* rides on the first bracket 220 past the second bracket 230 and prohibits the upward movement of the lock roller 210, as shown in FIG. 14.

Figure 4:
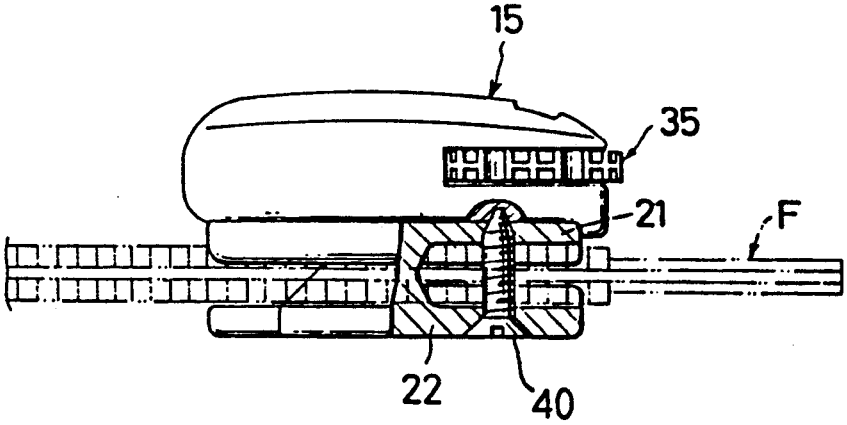
FIG. 4 is a side elevational, partly sectional view of the top end stop.
Figure 15:
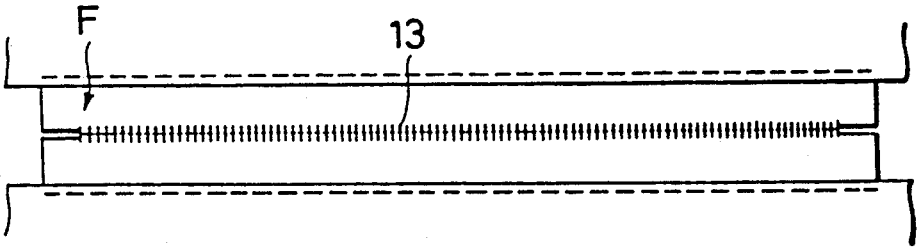
FIG. 15 is a diagrammatic plan view of an unfinished slide fastener chain attached to a garment fabric.
Figure 16:
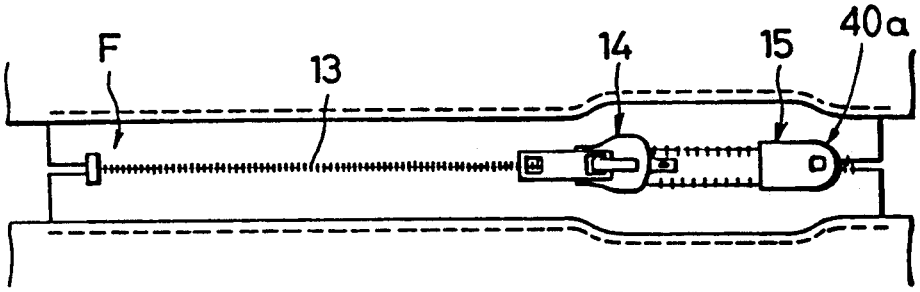
FIG. 16 is a view similar to FIG. 15 but showing a slide fastener finished with the slider and the top end stop according to the invention.

Having thus described the invention, it will be understood that the slider 14 can be brought into and out of engagement with the top end stop 15 efficiently and smoothly and that the top end stop 15 according to the invention can be freely moved along the rows of coupling elements 13 on a slide fastener chain F shown in FIG. 15 and can be secured thereto where described as by a threaded bolt 40 (FIG. 4) or by an adhesive 40*a* (FIG. 16), as shown in FIG. 16, to define a top end of an individual slide fastener 10 at which the slider 14 stopped and held optionally in "provisional lock" or "complete lock" engagement with the top end stop 15.

Another advantage of the invention is that a plurality of sliders 14 and top end stops 15 may be mounted alternately on a continuous length of slide fastener chain F and can be cut to individual product lengths at the site of garment manufacture.

Figure 17:
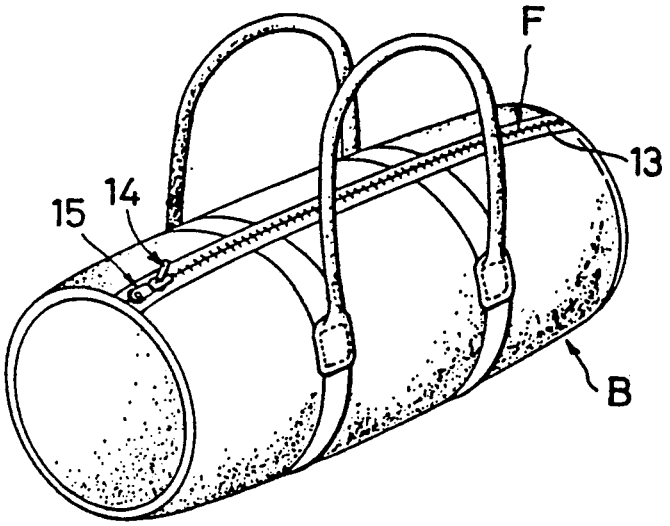
FIG. 17 is a diagrammatic perspective view of a bag to which the slide fastener of the invention is applied.

The slider 14 and the top end stop 15 according to the invention may be conveniently and suitably used on a bag B as shown in FIG. 17.

Obviously, various modifications and variations of the present invention are possible in the light of the above teaching. It is therefore to be understood that within the scope of the appended claims the invention may be practiced otherwise than as specifically described.

As for an example, the guide opening 24*c* may be provided in the slider 14 to which all the internal structural details of the top end stop 15 including the latch 26 (200) and the dial device 35 (260) may be transferred, and the wing extension 20 of the slider 14 may be transferred to the top end stop 15, the arrangement being that similar benefits of the invention may be attained.

What is claimed is:

1. A slide fastener comprising:

a pair of stringent tapes each carrying respective rows of coupling elements along their respective inner longitudinal edges, and a combination of slider and a top end stop both movable along said rows of coupling elements, said slider having an upper wing and a lower wing joined at one of their ends by a neck and defining therebetween a guide channel for the passage of said rows of coupling elements, and a wing extension extending forwardly of said neck and having a lock cavity, said top end stop having an upper wing and a lower wing jointed together by a neck and said top end stop having an upper wing extension and a lower wing extension extending from said upper wing and said lower wing respectively and forwardly of the neck, said upper and lower wing extensions being spaced in parallel with each other and defining therebetween a guide opening for receiving said wing extension of said slider, said top end stop being secured to a predetermined position of said stringer tapes by connecting means and said top end stop further incorporating a case encompassing and attached to said upper wing, a latch pivotally mounted in said casing and movable into and out of said guide opening and adapted to engage with said lock cavity, a spring normally urging said latch vertically toward said guide opening, and a slide bracket mounted in said casing horizontally movable, a control means for selectively locking and unlocking said latch, and a second spring normally urging said slide bracket horizontally toward said latch.

2. A slide fastener according to claim 1, wherein said connecting means comprises a threaded bolt.

3. A slide fastener according to claim 1, wherein said connecting means comprises an adhesive.

* * * * *